US007161118B1

(12) United States Patent
Modeste, Sr. et al.

(10) Patent No.: US 7,161,118 B1
(45) Date of Patent: Jan. 9, 2007

(54) TOILET SEAT HEATING DEVICE

(76) Inventors: David M. Modeste, Sr., 307 Forrest Crest Ct., Ocoee, FL (US) 34761; David M. Modeste, Jr., 307 Forrest Crest Ct., Ocoee, FL (US) 34761

( * ) Notice: Subject to any disclaimer, the term of this patent is extended or adjusted under 35 U.S.C. 154(b) by 356 days.

(21) Appl. No.: 10/891,272

(22) Filed: Jul. 15, 2004

(51) Int. Cl.
*H05B 1/00* (2006.01)

(52) U.S. Cl. ..... 219/217; 219/535; 219/527; 219/536; 4/237; 4/233; 4/246.1

(58) Field of Classification Search ..... 219/217, 219/527, 535, 536; 4/233, 237, 246.1
See application file for complete search history.

(56) References Cited

U.S. PATENT DOCUMENTS 1,839,156 A * 12/1931 Lumpkin ..... 4/233
2,717,953 A 9/1955 Brandi
2,972,034 A * 2/1961 Easley ..... 219/535
3,968,344 A * 7/1976 Gallegos, Sr. ..... 219/217
5,084,917 A * 2/1992 Matsubara et al. ..... 4/237
5,119,517 A 6/1992 Chang
D332,997 S 2/1993 Keefe
D349,760 S 8/1994 Schlumpf
5,642,531 A * 7/1997 Holtom et al. ..... 4/237
5,940,895 A * 8/1999 Wilson et al. ..... 4/237
6,294,758 B1 * 9/2001 Masao et al. ..... 219/217
6,307,180 B1 * 10/2001 Arx et al. ..... 219/217
2004/0078880 A1 * 4/2004 Hewton ..... 4/246.1

* cited by examiner

*Primary Examiner*—Robin Evans
*Assistant Examiner*—Leonid Fastovsky

(57) ABSTRACT

A device for warming a toilet seat includes a heatable section removably attachable to a toilet lid via an adhesive layer. The present invention further includes flexible heating elements formed from heat-absorbing material and a cover that protects a user from such elements. The device is activated when the toilet lid is in the closed position via a switch connected to the cover. The activating mechanism further includes a control panel that includes a temperature control lever. A power supply mechanism is electrically coupled to the activating mechanism.

18 Claims, 7 Drawing Sheets

TOILET SEAT HEATING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a heating device and, more particularly, to a seat heating device that keeps a toilet seat warm when the toilet is not in use.

2. Prior Art

The toilet is a household necessity to everyone, and therefore, every family, hotel, and public place has toilets for people to use. The most commonly used method of warming a toilet seat is by circulating hot water through the toilet seat. The purpose of such an apparatus, as described in the prior art, is to shield the user from "the discomfort and shock commonly experienced by using toilet seats in cold weather". Although construction methods and residential heating systems have vastly improved during the intervening years, the problem is still with us, albeit to a lesser degree.

Toilet seats can be quite cold, especially in the winter months, and can provide quite an unpleasant surprise to an unsuspecting user. The heat can also rob heat from the user's body as he sits, causing hip and back pain.

Accordingly, a need remains for a toilet seat heating device for providing comfort to a user during cold weather conditions. The present invention satisfies such a need by automatically heating a toilet seat through the heating device mounted on the toilet lid.

BRIEF SUMMARY OF THE INVENTION

In view of the foregoing background, it is therefore an object of the present invention to provide a toilet seat heating device. These and other objects, features, and advantages of the invention are provided by a device for warming selected portions of a toilet. Such a device includes a heatable section removably attachable to a lid portion of the toilet as well as an adhesive layer including a cover film attached thereto. Such a cover film is removable from the adhesive layer for allowing a user to affix the adhesive layer to the toilet lid.

Advantageously, the present invention further includes an insulating layer attached to the adhesive layer and has a corrugated shape for defining a plurality of channels therebeneath. Such channels are selectively spaced apart and extend along a perimeter of the adhesive layer wherein the adhesive layer is juxtaposed to the channels.

The present invention further includes a plurality of flexible heating elements formed from heat-absorbing material and passing through the channels respectively for causing the heatable section to dissipate air that has a predetermined temperature elevated above an ambient temperature. A cover is forwardly disposed from the adhesive layer so that the insulating layer and the heating elements become sandwiched therebetween. The cover further provides a non-conductive barrier for preventing a user from directly contacting the heating elements.

The present invention further includes a mechanism for selectively activating the device when the toilet lid is moved between open and closed positions. Such an activating mechanism is connected to the heating section.

The activating mechanism includes a plurality of lead lines that have opposed end portions connected to the heating elements and the power supply mechanism respectively. The lead lines are disposed along a non-continuous path for defining a gap therebetween. Furthermore, the activating mechanism may include a switch operably connected to the cover and being pivotal between compressed and released positions when the toilet lid is moved between closed and open positions respectively. Such a switch is positioned adjacent the gap, forming a bridge across the gap when the lid is moved to a closed position so that power can be supplied to the heating elements. Preferably, the switch is connected adjacent a bottom edge portion of the toilet lid so that the gap can be effectively bridged as the lid is moved to a closed position.

The activating mechanism preferably includes a control panel operably connected to the heatable section and including a temperature control lever for allowing a user to selectively control the predetermined air temperature during operating conditions. Such a control panel further includes a light source connected thereto for illuminating the temperature control lever. Furthermore, the control panel preferably includes an adhesive bottom layer for allowing a user to secure the control panel to a selected support surface.

The present invention further includes a power supply mechanism electrically coupled to the activating mechanism. Such a power supply source preferably includes a rechargeable battery pack.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
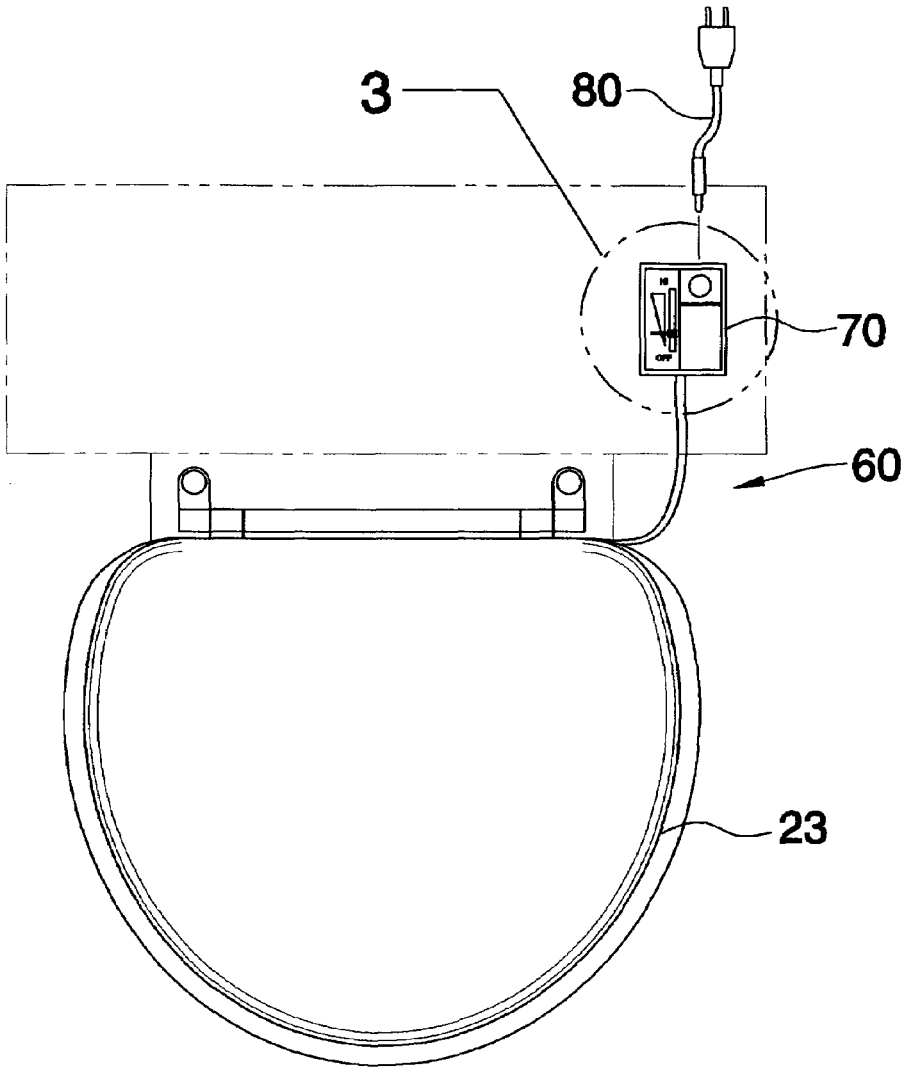
FIG. 1 is a top plan view showing a toilet seat warming device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–10 by the reference numeral 10 and is intended to warm a toilet seat while the toilet lid is down. It should be understood that the device 10 may be installed on a new toilet or be bought as a kit and mounted on a preexisting toilet.

Figure 9:
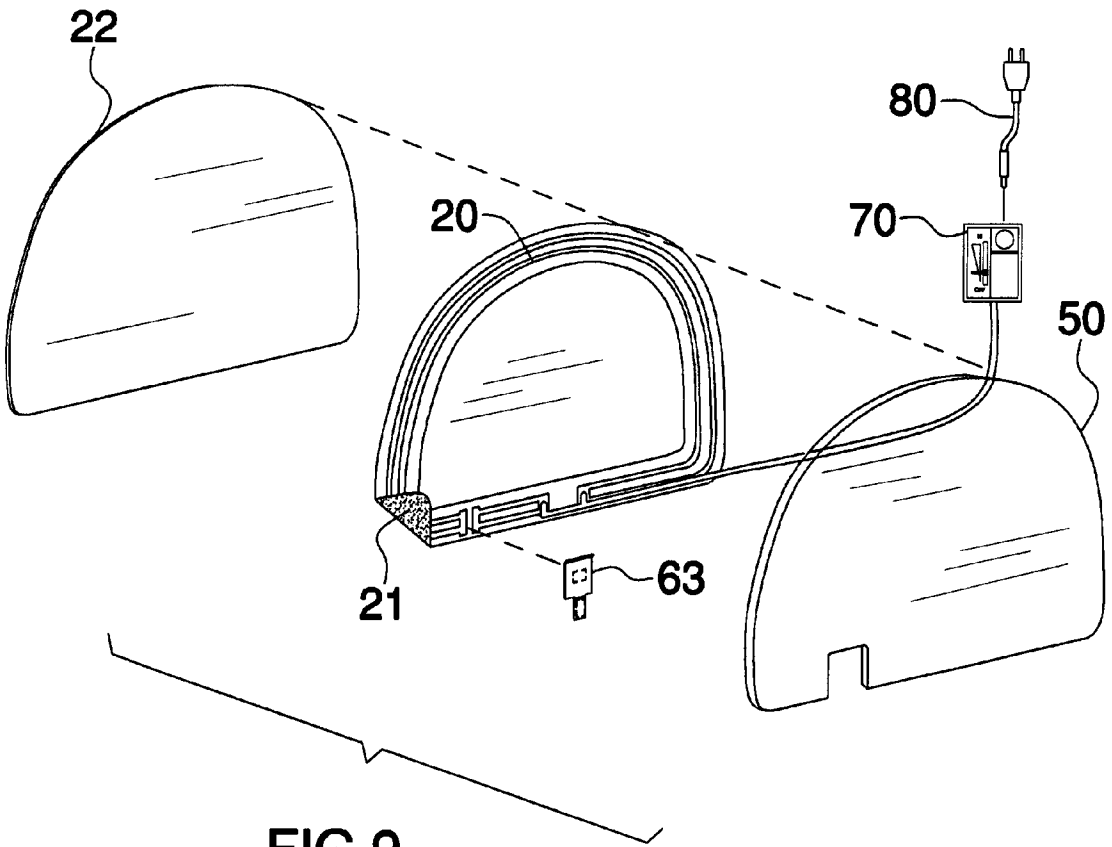
FIG. 9 is an exploded perspective view of the present invention.
Figure 10:
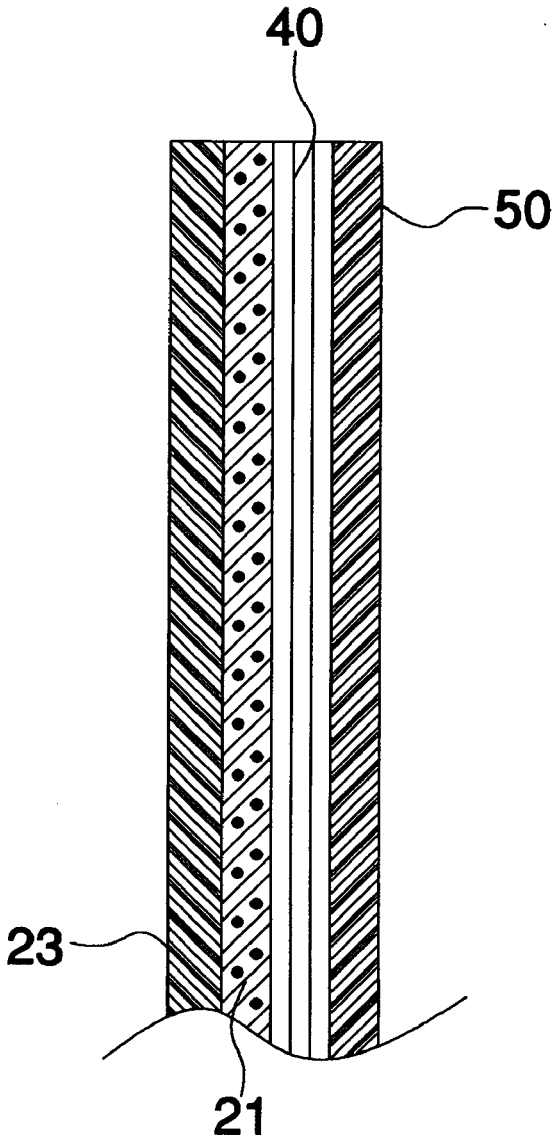
FIG. 10 is an enlarged cross-sectional view of the present invention shown in FIG. 9.

Referring initially to FIGS. 9 and 10, the device 10 includes a heatable section 20 removably attachable to a lid portion 23 of the toilet as well as an adhesive layer 21 including a cover film 22 attached thereto. Such a cover film 22 is removable from the adhesive layer 21 for allowing a user to affix the adhesive layer 21 to the toilet lid 23.

Figure 6:
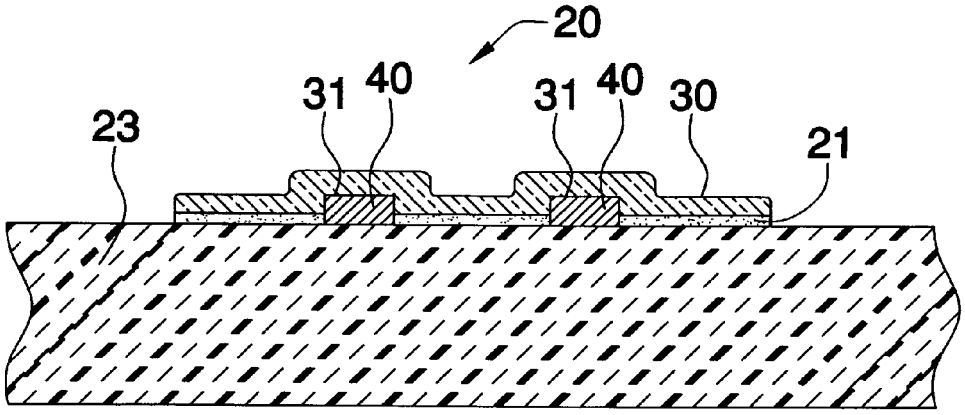
FIG. 6 is an enlarged cross-sectional view of a heating element shown in FIG. 2, taken along line 6—6.

Referring to FIG. 6, the present invention advantageously includes an insulating layer 30 attached to the adhesive layer 21 and has a corrugated shape for defining a plurality of channels 31 therebeneath. Such channels 31 are selectively spaced apart and extend along a perimeter of the adhesive layer 21 wherein the adhesive layer 21 is juxtaposed to the channels 31.

Figure 2:
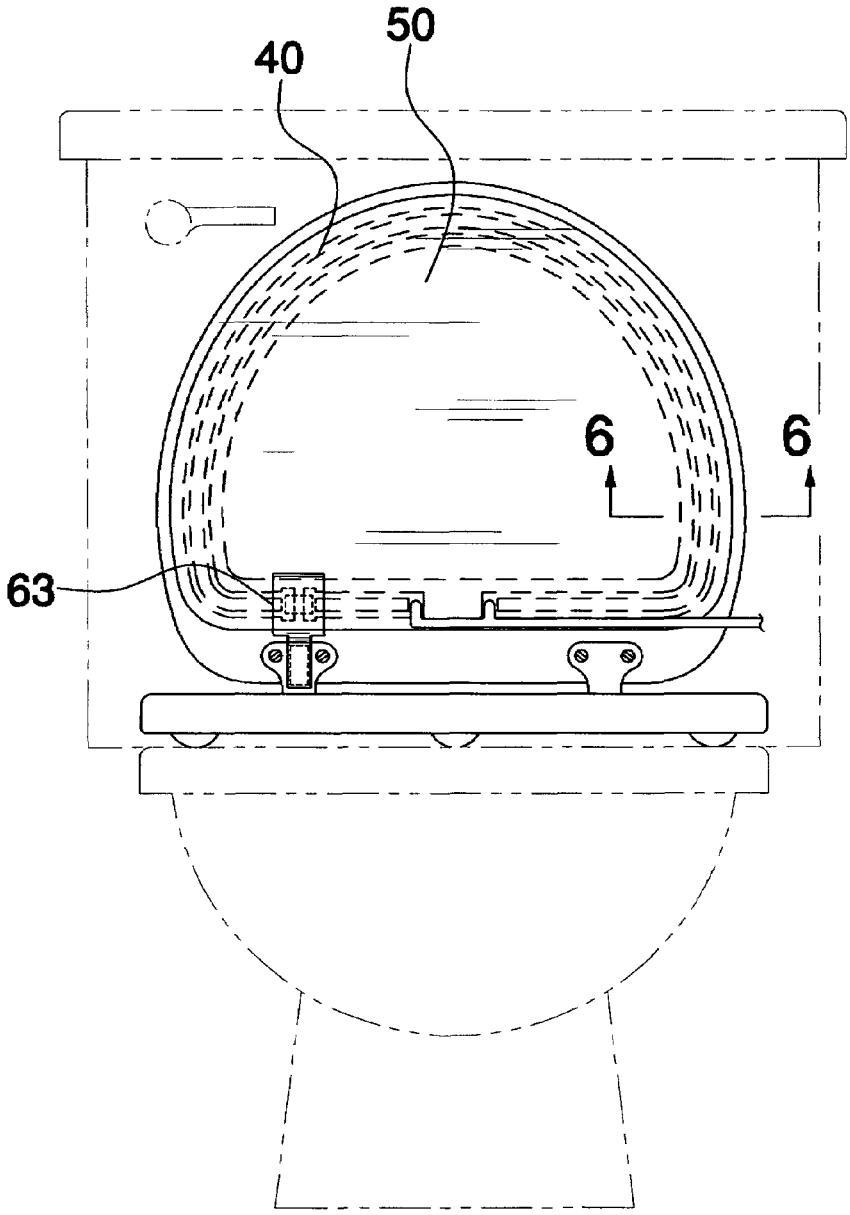
FIG. 2 is a front elevational view of a raised toilet lid with mounted heating elements.

Now referring to FIG. 2, the present invention further includes a plurality of flexible heating elements 40 formed from heat-absorbing material and passing through the channels 31 respectively for causing the heatable section 20 to dissipate air that has a predetermined temperature elevated above an ambient temperature. A cover 50 is forwardly disposed from the adhesive layer 21 so that the insulating layer 30 and the heating elements 40 become sandwiched therebetween. The cover 50 further provides a non-conductive barrier for preventing a user from directly contacting the heating elements 40 and is best shown in FIG. 9.

The present invention further includes a mechanism for selectively activating the device when the toilet lid 23 is moved between open and closed positions. Such an activating mechanism 60 is connected to the heating section 20, as best shown in FIG. 2.

Figure 7:
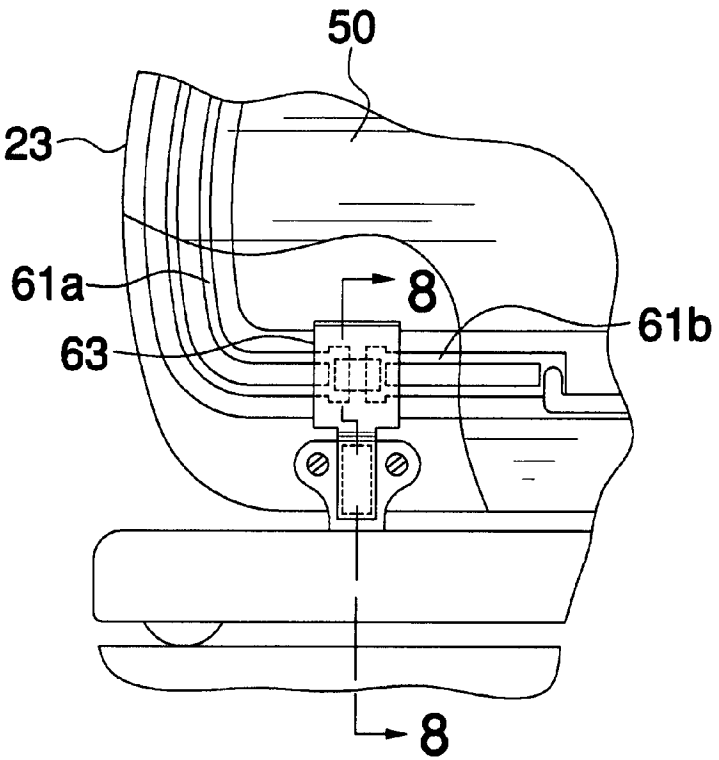
FIG. 7 is an enlarged front elevational view of the switch shown in FIG. 2.
Figure 8:
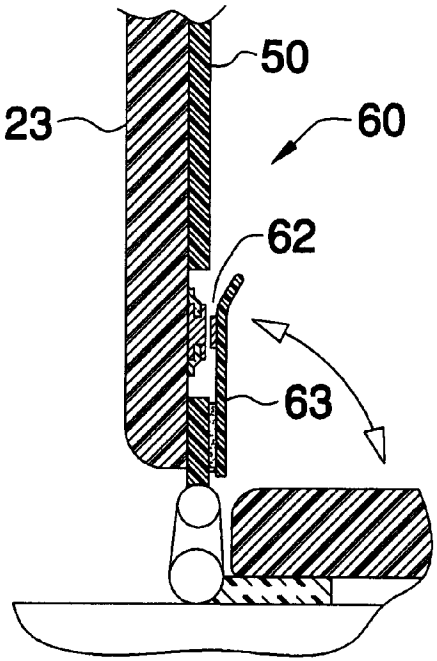
FIG. 8 is an enlarged cross-sectional view of the switch member shown in FIG. 7, taken along line 8—8.

Referring to FIGS. 7 and 8, the activating mechanism 60 includes a plurality of lead lines that have opposed end portions 61*a*, 61*b* connected to the heating elements 40 and the power supply mechanism (not shown) respectively. The lead lines 61 are disposed along a non-continuous path for defining a gap 62 therebetween. Furthermore, the activating mechanism 60 may include a switch 63 operably connected to the cover 50 and being pivotal between compressed and released positions when the toilet lid 23 is moved between closed and open positions respectively. Such a switch 63 is positioned adjacent the gap 62, forming a bridge across the gap 62 when the lid 23 is moved to a closed position so that power can be supplied to the heating elements 40. Preferably, the switch 63 is connected adjacent a bottom edge portion of the toilet lid 23 so that the gap 62 can be effectively bridged as the lid 23 is moved to a closed position.

Figure 4:
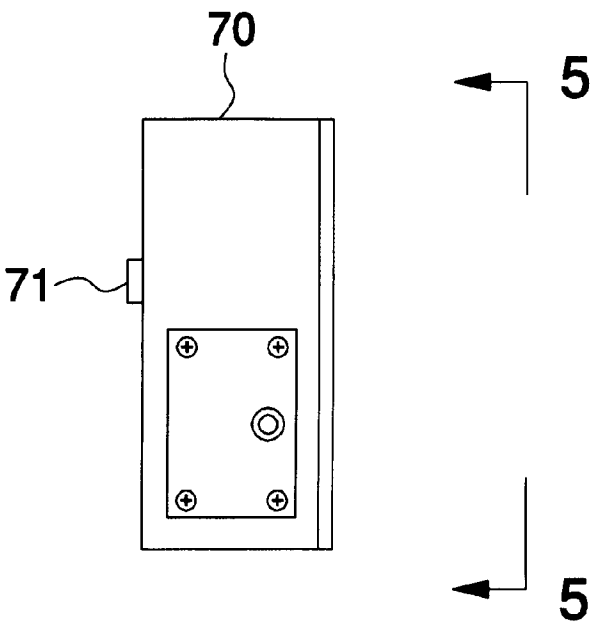
FIG. 4 is a side elevational view of the control panel shown in FIG. 3.
Figure 3:
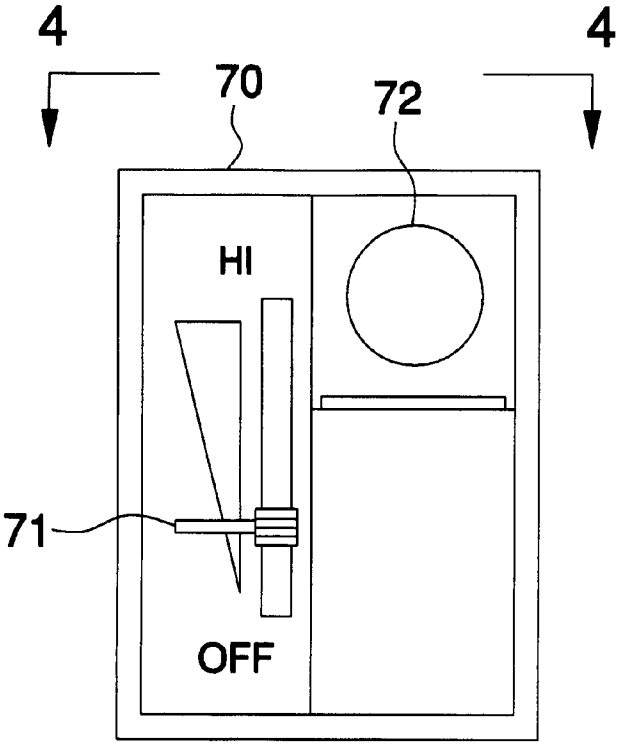
FIG. 3 is an enlarged top plan view of the control panel shown in FIG. 1.
Figure 5:
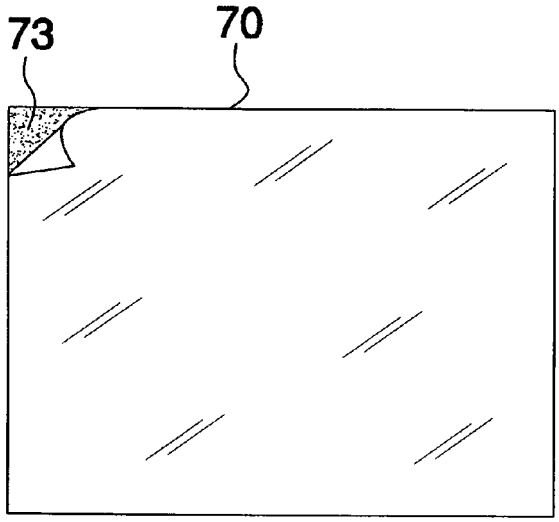
FIG. 5 is a rear elevational view of the control panel in FIG. 3 showing the adhesive layer.

Referring to FIGS. 3 and 4, the activating mechanism 60 preferably includes a control panel 70 operably connected to the heatable section 20 and including a temperature control lever 71 for allowing a user to selectively control the predetermined air temperature during operating conditions. Such a control panel 70 further includes a light source 72 connected thereto for illuminating the temperature control lever 71. Furthermore, the control panel 70 preferably includes an adhesive bottom layer 73 for allowing a user to secure the control panel 70 to a selected support surface, as best shown in FIG. 5.

Referring to FIG. 1, the present invention further includes a power supply mechanism 80 electrically coupled to the activating mechanism 60. Such a power supply source 80 preferably includes a rechargeable battery pack (not shown).

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for warming selected portions of a toilet, said device comprising:

a heatable section removably attachable to a lid portion of the toilet and comprising an adhesive layer including a cover film attached thereto, said cover film being removable from said adhesive layer for allowing a user to affix said adhesive layer to the toilet lid, an insulating layer attached to said adhesive layer and having a corrugated shaped for defining a plurality of channel therebeneath, said channels being selectively spaced apart and extending along a perimeter of said adhesive layer, a plurality of heating elements passing through said channels respectively and for causing said heatable section to dissipate air having a predetermined temperature elevated above an ambient temperature, and a cover forwardly disposed from said adhesive layer so that said insulating layer and said heating elements become sandwiched therebetween, said cover further providing a non-conductive barrier for preventing a user from directly contacting said heating elements;

means for selectively activating said device when the toilet lid is moved between open and closed positions, said activating means being connected to said heating section; and power supply means electrically coupled to said activating means.

2. The device of claim 1, wherein said activating means comprises:

a plurality of lead lines having opposed end portion connected to said heating elements and said power supply means respectively, said lead lines being disposed along a non-continuous path for defining a gap therebetween;

a switch operably connected to said cover and being pivotal between compressed and released positions when the toilet lid is moved between closed and open positions respectively, said switch being positioned adjacent the gap and forming a bridge across the gap when the lid is moved to a closed position so that power can be supplied to said heating elements.

3. The device of claim 2, wherein said switch is connected adjacent a bottom edge portion of the toilet lid so that the gap can be effectively bridged as the lid is moved to a closed position.

4. The device of claim 2, wherein said activating means comprises: a control panel operably connected to said heatable section and including a temperature control lever for allowing a user to selectively control the predetermined air temperature during operating conditions, said control panel further including a light source connected thereto for illuminating said temperature control lever.

5. The device of claim 1, wherein said power supply source comprises: a rechargeable battery pack.

6. The device of claim 4, wherein said control panel further comprises: an adhesive bottom layer for allowing a user to secure said control panel to a selected support surface.

7. A device for warming selected portions of a toilet, said device comprising:

a heatable section removably attachable to a lid portion of the toilet and comprising an adhesive layer including a cover film attached thereto, said cover film being removable from said adhesive layer for allowing a user to affix said adhesive layer to the toilet lid, an insulating layer attached to said adhesive layer and having a corrugated shaped for defining a plurality of channel therebeneath, said channels being selectively spaced apart and extending along a perimeter of said adhesive layer wherein said adhesive layer is juxtaposed to the channels, a plurality of heating elements passing through said channels respectively and for causing said heatable section to dissipate air having a predetermined temperature elevated above an ambient temperature, and a cover forwardly disposed from said adhesive layer so that said insulating layer and said heating elements become sandwiched therebetween, said cover further providing a non-conductive barrier for preventing a user from directly contacting said heating elements;

means for selectively activating said device when the toilet lid is moved between open and closed positions, said activating means being connected to said heating section; and power supply means electrically coupled to said activating means.

8. The device of claim 7, wherein said activating means comprises:

a plurality of lead lines having opposed end portion connected to said heating elements and said power supply means respectively, said lead lines being disposed along a non-continuous path for defining a gap therebetween;

a switch operably connected to said cover and being pivotal between compressed and released positions when the toilet lid is moved between closed and open positions respectively, said switch being positioned adjacent the gap and forming a bridge across the gap when the lid is moved to a closed position so that power can be supplied to said heating elements.

9. The device of claim 8, wherein said switch is connected adjacent a bottom edge portion of the toilet lid so that the gap can be effectively bridged as the lid is moved to a closed position.

10. The device of claim 8, wherein said activating means comprises: a control panel operably connected to said heatable section and including a temperature control lever for allowing a user to selectively control the predetermined air temperature during operating conditions, said control panel further including a light source connected thereto for illuminating said temperature control lever.

11. The device of claim 7, wherein said power supply source comprises: a rechargeable battery pack.

12. The device of claim 11, wherein said control panel further comprises: an adhesive bottom layer for allowing a user to secure said control panel to a selected support surface.

13. A device for warming selected portions of a toilet, said device comprising:

a heatable section removably attachable to a lid portion of the toilet and comprising an adhesive layer including a cover film attached thereto, said cover film being removable from said adhesive layer for allowing a user to affix said adhesive layer to the toilet lid, an insulating layer attached to said adhesive layer and having a corrugated shaped for defining a plurality of channel therebeneath, said channels being selectively spaced apart and extending along a perimeter of said adhesive layer wherein said adhesive layer is juxtaposed to the channels, a plurality of flexible heating elements formed from heat-absorbing material and passing through said channels respectively and for causing said heatable section to dissipate air having a predetermined temperature elevated above an ambient temperature, and a cover forwardly disposed from said adhesive layer so that said insulating layer and said heating elements become sandwiched therebetween, said cover further providing a non-conductive barrier for preventing a user from directly contacting said heating elements;

means for selectively activating said device when the toilet lid is moved between open and closed positions, said activating means being connected to said heating section; and power supply means electrically coupled to said activating means.

14. The device of claim 13, wherein said activating means comprises:

a plurality of lead lines having opposed end portion connected to said heating elements and said power supply means respectively, said lead lines being disposed along a non-continuous path for defining a gap therebetween;

a switch operably connected to said cover and being pivotal between compressed and released positions when the toilet lid is moved between closed and open positions respectively, said switch being positioned adjacent the gap and forming a bridge across the gap when the lid is moved to a closed position so that power can be supplied to said heating elements.

15. The device of claim 14, wherein said switch is connected adjacent a bottom edge portion of the toilet lid so that the gap can be effectively bridged as the lid is moved to a closed position.

16. The device of claim 14, wherein said activating means comprises: a control panel operably connected to said heatable section and including a temperature control lever for allowing a user to selectively control the predetermined air temperature during operating conditions, said control panel further including a light source connected thereto for illuminating said temperature control lever.

17. The device of claim 13, wherein said power supply source comprises: a rechargeable battery pack.

18. The device of claim 17, wherein said control panel further comprises: an adhesive bottom layer for allowing a user to secure said control panel to a selected support surface.

* * * * *